US011267016B1

(12) United States Patent
Williams, Jr.

(10) Patent No.: US 11,267,016 B1
(45) Date of Patent: Mar. 8, 2022

(54) COLLAPSIBLE TUBING CAULKING GUN

(71) Applicant: Milton A. Williams, Jr., N. Chesterfield, VA (US)

(72) Inventor: Milton A. Williams, Jr., N. Chesterfield, VA (US)

( * ) Notice: Subject to any disclaimer, the term of this patent is extended or adjusted under 35 U.S.C. 154(b) by 156 days.

(21) Appl. No.: 16/882,821

(22) Filed: May 26, 2020

(51) Int. Cl.
*B05C 17/005* (2006.01)
*B05C 17/01* (2006.01)

(52) U.S. Cl.
CPC ..... *B05C 17/00583* (2013.01); *B05C 17/005* (2013.01); *B05C 17/00506* (2013.01); *B05C 17/00516* (2013.01); *B05C 17/01* (2013.01)

(58) Field of Classification Search
CPC ..... B05C 17/005; B05C 17/00506; B05C 17/00583; B05C 17/00596; B65D 35/28–285; B65D 35/32–34
USPC ..... 222/104, 103, 99, 98, 386–391, 405
See application file for complete search history.

(56) References Cited

U.S. PATENT DOCUMENTS 1,924,195 A 8/1933 Miles
3,006,508 A * 10/1961 Preidel ..... B65D 35/285 222/98
3,187,951 A 6/1965 Hardman
3,581,943 A * 6/1971 Koenigshof ..... B65D 35/285 222/102
4,585,147 A 4/1986 Wodnicki
4,998,645 A * 3/1991 Pearson ..... B05C 17/005 222/102
5,069,365 A 12/1991 Woodhouse
5,421,486 A * 6/1995 Simmons ..... B65D 35/34 222/100
6,435,373 B1 8/2002 Mizrahi
6,966,457 B1 * 11/2005 Torbet ..... B65D 35/285 222/101
D654,768 S 2/2012 Rumrill
10,392,164 B2 * 8/2019 Uno ..... B65D 35/285
2002/0011497 A1 * 1/2002 Farris ..... A61M 5/148 222/102
2005/0198927 A1 9/2005 Summons

FOREIGN PATENT DOCUMENTS

GB 2186544 10/1988
KR 10600644 * 7/2006

* cited by examiner

*Primary Examiner* — Frederick C Nicolas
*Assistant Examiner* — Randall A Gruby
(74) *Attorney, Agent, or Firm* — Kyle A. Fletcher, Esq.

(57) ABSTRACT

The collapsible tubing caulking gun comprises a handle, a trigger, a squeegee, a tube grip, and a nozzle support. The collapsible tubing caulking gun may dispense caulk from a collapsible tube. Activation of the trigger may force the collapsible tube rearwards through the squeegee resulting in the caulk being forced out of the collapsible tube via a nozzle. The collapsible tube may be retained between the tube grip which retains a sealed end of the collapsible tube and the nozzle support which retains the nozzle of the collapsible tube.

18 Claims, 5 Drawing Sheets

COLLAPSIBLE TUBING CAULKING GUN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of tools, more specifically, a collapsible tubing caulking gun.

SUMMARY OF INVENTION

The collapsible tubing caulking gun comprises a handle, a trigger, a squeegee, a tube grip, and a nozzle support. The collapsible tubing caulking gun may dispense caulk from a collapsible tube. Activation of the trigger may force the collapsible tube rearwards through the squeegee resulting in the caulk being forced out of the collapsible tube via a nozzle. The collapsible tube may be retained between the tube grip which retains a sealed end of the collapsible tube and the nozzle support which retains the nozzle of the collapsible tube.

An object of the invention is to dispense caulk from a collapsible tube.

Another object of the invention is to retain the collapsible tube between a nozzle support and a tube grip.

A further object of the invention is to pull the collapsible tube rearwards using the tube grip such that the collapsible tube passes through the squeegee.

Yet another object of the invention is to adjust the distance between a nozzle aperture and the tube grip to match the size of the collapsible tube.

These together with additional objects, features and advantages of the collapsible tubing caulking gun will be readily apparent to those of ordinary skill in the art upon reading the following detailed description of the presently preferred, but nonetheless illustrative, embodiments when taken in conjunction with the accompanying drawings.

In this respect, before explaining the current embodiments of the collapsible tubing caulking gun in detail, it is to be understood that the collapsible tubing caulking gun is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the collapsible tube caulking gun.

It is therefore important that the claims be regarded as including such equivalent construction insofar as they do not depart from the spirit and scope of the collapsible tubing caulking gun. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
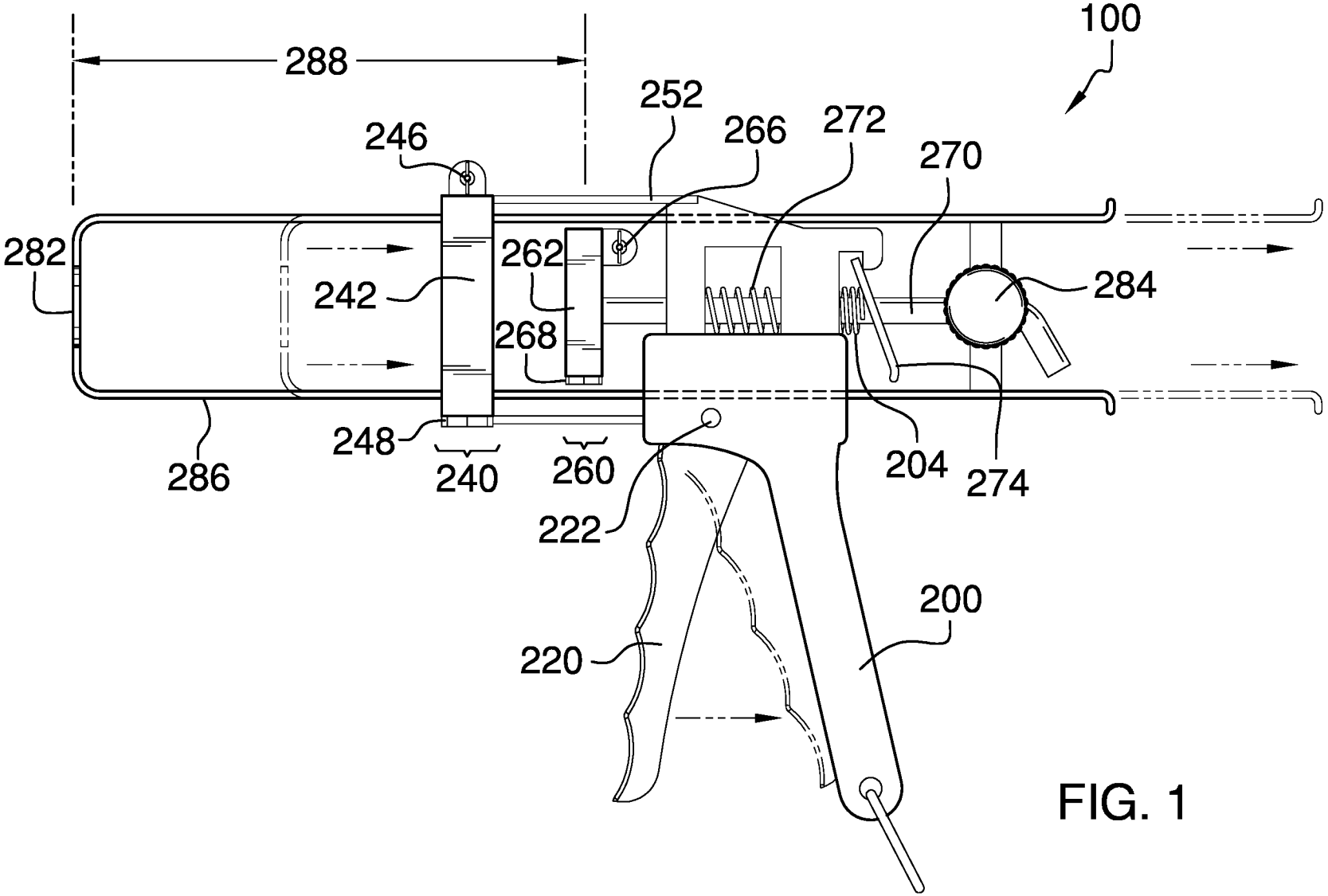
FIG. 1 is a side view of an embodiment of the disclosure.
Figure 2:
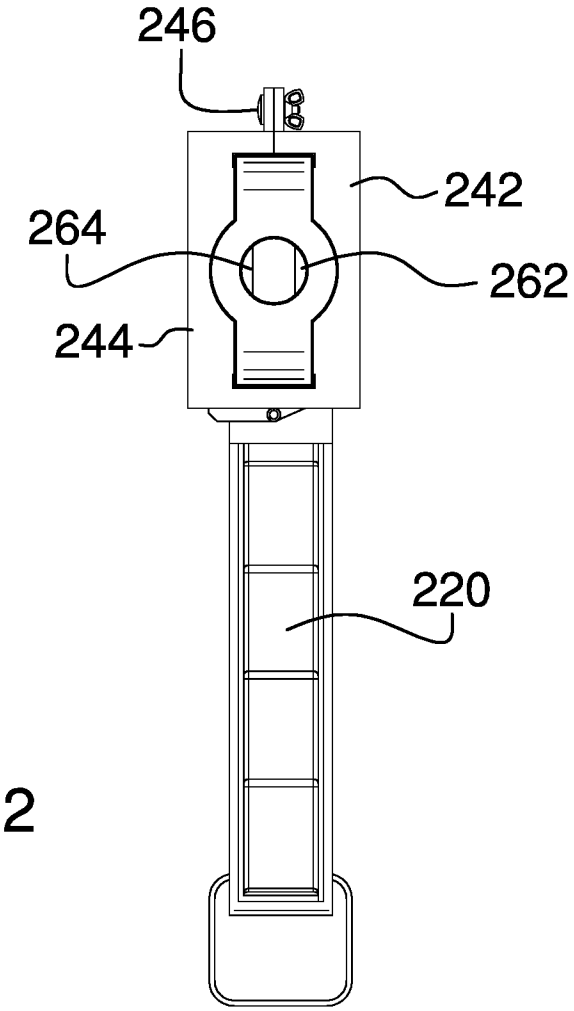
FIG. 2 is a front view of an embodiment of the disclosure.
Figure 3:
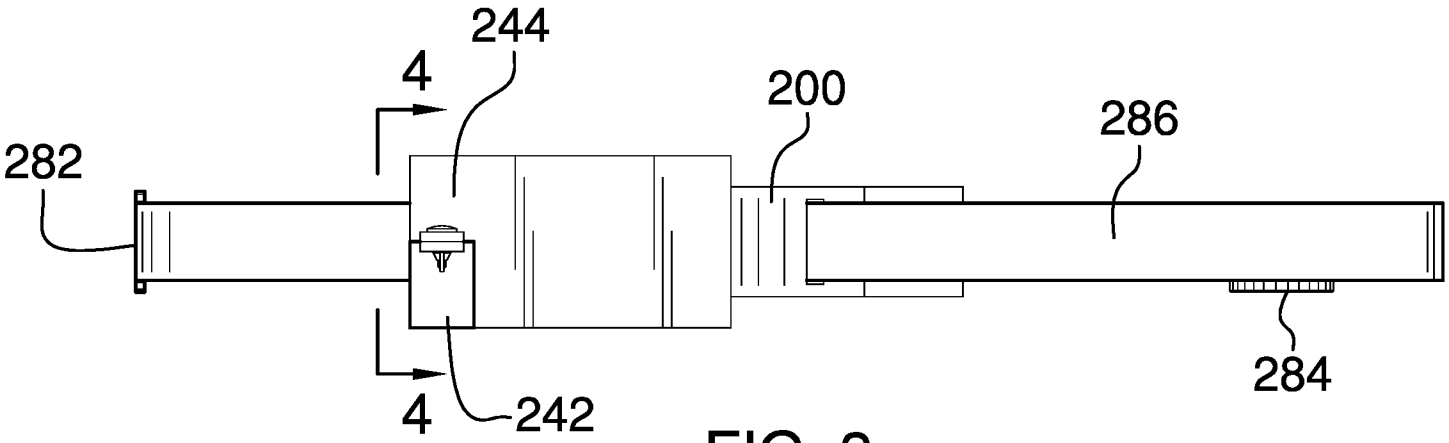
FIG. 3 is a top view of an embodiment of the disclosure.
Figure 4:
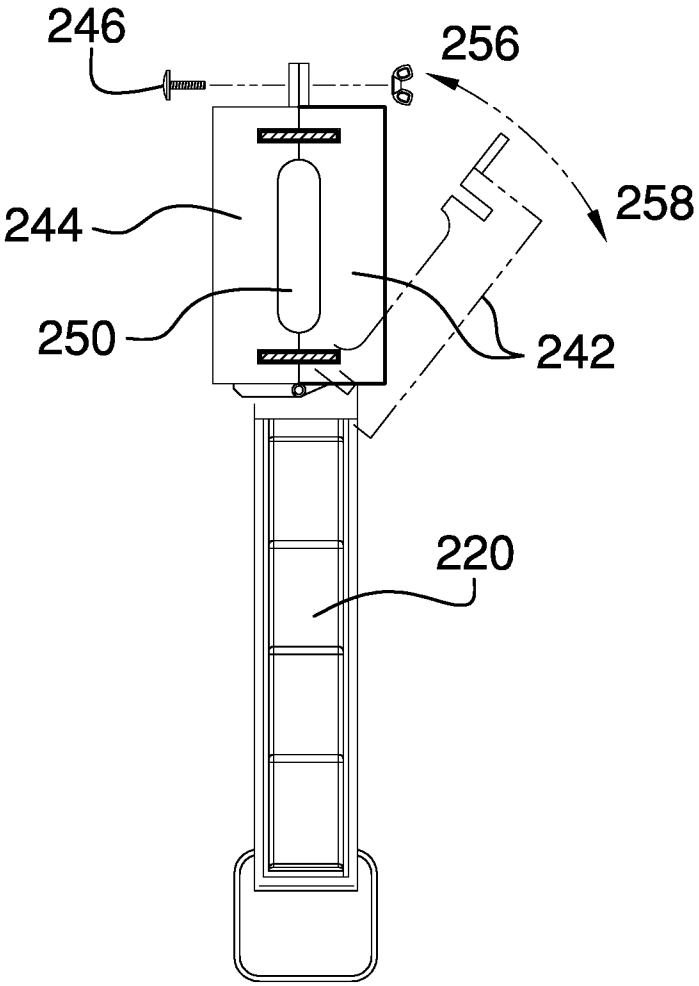
FIG. 4 is a cross-sectional view of an embodiment of the disclosure across 4-4 as shown in FIG. 3.
Figure 5:
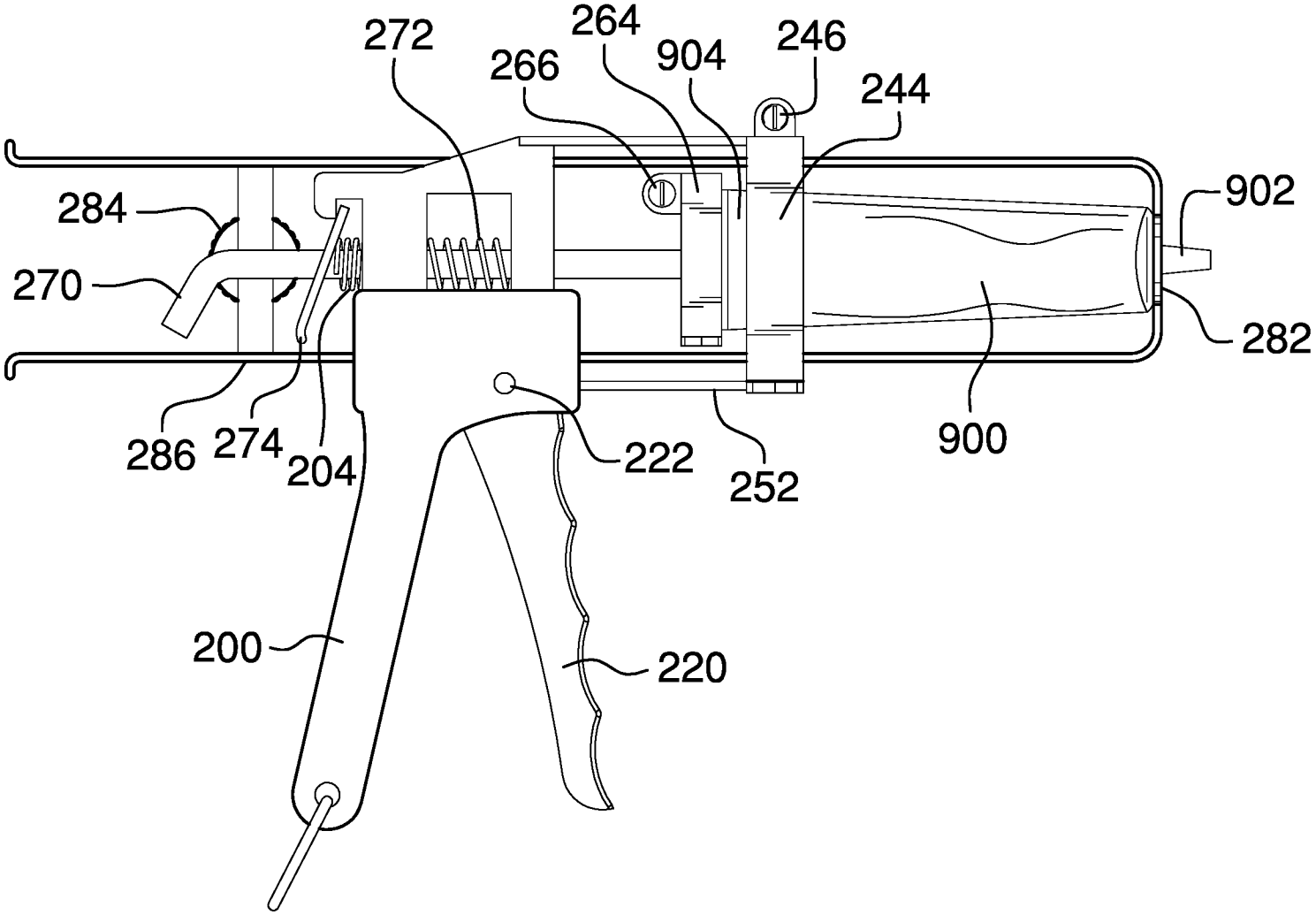
FIG. 5 is an in-use view of an embodiment of the disclosure illustrating a collapsible tube in place.

Detailed reference will now be made to a first potential embodiment of the disclosure, which is illustrated in FIGS. 1 through 5.

The collapsible tubing caulking gun 100 (hereinafter invention) comprises a handle 200, a trigger 220, a squeegee 240, a tube grip 260, and a nozzle support. The invention 100 may dispense caulk from a collapsible tube 900. Activation of the trigger 220 may force the collapsible tube 900 rearwards through the squeegee 240 resulting in the caulk being forced out of the collapsible tube 900 via a nozzle 902. The collapsible tube 900 may be retained between the tube grip 260 coupled at a sealed end 904 of the collapsible tube 900 and the nozzle support coupled at the nozzle 902 of the collapsible tube 900.

The handle 200 may be adapted to be held by a user during operation of the invention 100. The handle 200 may be operable to support the trigger 220, the squeegee 240 via a squeegee support armature 252, and the tube grip 260 via a grip armature 270. The trigger 220 may pivotably couple to the handle 200 via a pivot pin 222. The grip armature 270 may slidably couple to the handle 200. The squeegee support armature 252 may couple to the handle 200.

The trigger 220 and the handle 200 may be adapted to pivot towards each other when the user squeezes the trigger 220 and the handle 200 in order to dispense the caulk. The grip armature 270 may move rearwards when the trigger 220 and the handle 200 are squeezed together. The grip armature 270 may pull the tube grip 260 rearward as the grip armature 270 moves rearward. The tube grip 260 may pull the collapsible tube 900 rearward as the tube grip 260 moves rearward. The trigger 220 and the handle 200 may be adapted to separate when the user releases the trigger 220.

The squeegee 240 may form a constriction 250 that the collapsible tube 900 may be pulled through. The caulk within the collapsible tube 900 may be displaced towards the nozzle 902 of the collapsible tube 900 as the collapsible tube 900 collapses to fit through the constriction 250. Displacement of the caulk towards the nozzle 902 may result in the caulk being forced out of the collapsible tube 900 at the nozzle 902.

The squeegee 240 may comprise a squeegee backer 244, a squeegee flap 242, and a squeegee fastener 246. The squeegee backer 244 may be coupled to the squeegee support armature 252 and may move with the squeegee support armature 252. The squeegee flap 242 may hingedly couple to the squeegee backer 244 via a squeegee hinge 248. The squeegee flap 242 may be moved to a squeegee closed position 256 where the squeegee flap 242 may be adjacent the squeegee backer 244 with the constriction 250 between the squeegee backer 244 and the squeegee flap 242. The squeegee flap 242 may be retained in the squeegee closed position 256 by the squeegee fastener 246. The squeegee flap 242 may be moved to a squeegee open position 258 where the sealed end 904 of the collapsible tube 900 may be removed from or inserted into the squeegee 240 by releasing the squeegee fastener 246 and pivoting the squeegee flap 242.

The squeegee support armature 252 may be one or more armatures that each couple to the squeegee 240 at one end and couple to the handle 200 at the opposing end. The squeegee support armature 252 may hold the squeegee 240 in a fixed position such that the collapsible tube 900 may be pulled rearwards through the squeegee 240.

The tube grip 260 may be a clamp that removably couples to the sealed end 904 of the collapsible tube 900 for the purpose of pulling the collapsible tube 900 rearwards. The tube grip 260 may comprise a grip backer 264, a grip flap 262, and a grip fastener 266. The grip backer 264 may be coupled to the grip armature 270 and may move with the grip armature 270. The grip flap 262 may hingedly couple to the grip backer 264 via a grip hinge 268. The grip flap 262 may be moved to a grip closed position where the grip flap 262 may be adjacent the grip backer 264. The grip flap 262 may be retained in the grip closed position by the grip fastener 266. In some embodiments, the squeegee fastener 246, the grip fastener 266, or both may be thumbscrews. The grip flap 262 may be moved to a grip open position where the sealed end 904 of the collapsible tube 900 may be removed or inserted into the tube grip 260 by releasing the grip fastener 266 and pivoting the grip flap 262.

The grip armature 270 may be an armature that couples to the grip backer 264 and slidably couples to the handle 200. The grip armature 270 may be moved rearward by the action of squeezing the trigger 220 and the handle 200. The grip armature 270 may be moved forward by force exerted by a grip spring 272. A grip release 274 may prevent the grip armature 270 from moving forward unless the grip release 274 is activated. In some embodiments, the grip release 274 may be activated by pressing the bottom of the grip release 274 towards the handle 200. A release spring 204 may hold the grip release 274 in a position that prevents movement of the grip armature 270.

The nozzle support may support the front of the collapsible tube 900 at the nozzle 902. The nozzle support may comprise a nozzle support armature 286, a nozzle aperture 282, and a nozzle release 284. The nozzle support armature 286 may be one or more armatures that extend forward to the nozzle 902 of the collapsible tube 900. The nozzle aperture 282 may be an opening at the front of the nozzle support armature 286 that is oriented to surround the nozzle 902. The nozzle 902 may be inserted into the nozzle aperture 282 to support the front of the collapsible tube 900. The nozzle support armature 286 may extend towards the rear of the invention 100 and may slidably couple with the grip armature 270 via the nozzle release 284. The nozzle release 284 may couple the nozzle support armature 286 to the grip armature 270 such that the nozzle support armature 286 moves with the grip armature 270 when the nozzle release 284 is in an engaged position. The nozzle release 284 may decouple the nozzle support armature 286 from the grip armature 270 such that the nozzle support armature 286 moves independently of the grip armature 270 when the nozzle release 284 is in a disengaged position. The nozzle support armature 286 may be moved independently of the grip armature 270 to adjust a distance 288 between the nozzle aperture 282 and the tube grip 260 to match the size of the collapsible tube 900.

As a non-limiting example, the nozzle release 284 may be a thumbscrew, the engaged position may be a tightening of the nozzle release 284, and the disengaged position may be a loosening of the nozzle release 284.

In use, the nozzle release 284 may be disengaged and the distance 288 between the nozzle aperture 282 and the tube grip 260 may be changed to match the size of the collapsible tube 900. The grip flap 262 may be moved to the grip open position and the squeegee flap 242 may be moved to the squeegee open position 258. The nozzle 902 of the collapsible tube 900 may be passed through the nozzle aperture 282 and the grip flap 262 may be moved to the grip closed position. The squeegee flap 242 may be moved to the squeegee closed position 256. The squeegee fastener 246 and the grip fastener 266 may lock the squeegee 240 and the tube grip 260 closed. The caulk may be dispensed by squeezing the trigger 220 and the handle 200 together.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface. Aperture may be synonymous with hole, slit, crack, gap, slot, or opening.

As used herein, the words "couple", "couples", "coupled" or "coupling", may refer to connecting, either directly or indirectly, and does not necessarily imply a mechanical connection.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used herein, "handle" may refer to an object by which a tool, object, or door is held or manipulated with the hand.

As used in this disclosure, a "hinge" may be a device that permits the turning, rotating, or pivoting of a first object relative to a second object.

As used herein, the word "pivot" may include any mechanical arrangement that allows for rotational motion. Non-limiting examples of pivots may include hinges, holes, posts, dowels, pins, points, rods, shafts, balls, and sockets, either individually or in combination.

As used in this disclosure, a "spring" may be a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used herein, "thumb screw" and "wing nut" refer to fasteners that are designed to be tightened and loosened by hand without the use of tools. As non-limiting examples, thumb screws and wing nuts may be screws, bolts, or nuts that include any or all of the following features: oversized dimensions, knurled sides, one or more upward extensions, or one or more lateral extensions.

As used in this disclosure, a "trigger" may be a lever that operates in conjunction with a spring or similar device such that the lever may be used to activate a mechanism and the spring or similar device may return the lever to its original position after the mechanism has been activated.

As used in this disclosure, a "tube" or "tubing" may refer to a hollow cylindrical device that is used for transporting liquids and/or gases. In this disclosure, the terms inner diameter and outer diameter are used as they would be used by those skilled in the plumbing arts. The line that connects the center of the first base of the cylinder to the center of the second base of the cylinder and is equidistant from the outer surface of the tube for its entire length is referred to as the centerline of the tube. When two tubes share the same centerline they are said to be aligned. When the centerlines of two tubes are perpendicular to each other, the tubes are said to be perpendicular to each other. As used here, "tubing" may refer to a tube that is flexible or resilient.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A collapsible tubing caulking gun comprising:

a handle, a trigger, a squeegee, a tube grip, and a nozzle support;

wherein the collapsible tubing caulking gun dispenses caulk from a collapsible tube;

wherein activation of the trigger forces the collapsible tube rearwards through the squeegee resulting in the caulk being forced out of the collapsible tube via a nozzle;

wherein the collapsible tube is retained between the tube grip coupled at a sealed end of the collapsible tube and the nozzle support coupled at the nozzle of the collapsible tube;

wherein the handle is adapted to be held by a user during operation of the collapsible tubing caulking gun;

wherein the handle is operable to support the trigger, the squeegee via a squeegee support armature, and the tube grip via a grip armature; wherein the trigger pivotably couples to the handle via a pivot pin;

wherein the grip armature slidably couples to the handle;

wherein the squeegee support armature couples to the handle.

2. The collapsible tubing caulking gun according to claim 1 wherein the trigger and the handle are adapted to pivot towards each other when the user squeezes the trigger and the handle in order to dispense the caulk;

wherein the grip armature moves rearwards when the trigger and the handle are squeezed together;

wherein the grip armature pulls the tube grip rearward as the grip armature moves rearward;

wherein the tube grip pulls the collapsible tube rearward as the tube grip moves rearward.

3. The collapsible tubing caulking gun according to claim 2 wherein the trigger and the handle are adapted to separate when the user releases the trigger.

4. The collapsible tubing caulking gun according to claim 3 wherein the squeegee forms a constriction that the collapsible tube is pulled through;

wherein the caulk within the collapsible tube is displaced towards the nozzle of the collapsible tube as the collapsible tube collapses to fit through the constriction;

wherein displacement of the caulk towards the nozzle results in the caulk being forced out of the collapsible tube at the nozzle.

5. The collapsible tubing caulking gun according to claim 4 wherein the squeegee comprises a squeegee backer, a squeegee flap, and a squeegee fastener;

wherein the squeegee backer is coupled to the squeegee support armature and moves with the squeegee support armature;

wherein the squeegee flap hingedly couples to the squeegee backer via a squeegee hinge;

wherein the squeegee flap is moved to a squeegee closed position where the squeegee flap is adjacent the squeegee backer with the constriction between the squeegee backer and the squeegee flap;

wherein the squeegee flap is retained in the squeegee closed position by the squeegee fastener.

6. The collapsible tubing caulking gun according to claim 5 wherein the squeegee flap is moved to a squeegee open position where the sealed end of the collapsible tube is removed from or inserted into the squeegee by releasing the squeegee fastener and pivoting the squeegee flap.

7. The collapsible tubing caulking gun according to claim 6 wherein the squeegee support armature is one or more armatures that each couple to the squeegee at one end and couple to the handle at the opposing end;

wherein the squeegee support armature holds the squeegee in a fixed position such that the collapsible tube is pulled rearwards through the squeegee.

8. The collapsible tubing caulking gun according to claim 7 wherein the tube grip is a clamp that removably couples to the sealed end of the collapsible tube for the purpose of pulling the collapsible tube rearwards.

9. The collapsible tubing caulking gun according to claim 8 wherein the tube grip comprises a grip backer, a grip flap, and a grip fastener;

wherein the grip backer is coupled to the grip armature and moves with the grip armature;

wherein the grip flap hingedly couples to the grip backer via a grip hinge;

wherein the grip flap is moved to a grip closed position where the grip flap is adjacent the grip backer;

wherein the grip flap is retained in the grip closed position by the grip fastener.

10. The collapsible tubing caulking gun according to claim 9 wherein the squeegee fastener, the grip fastener, or both are thumbscrews.

11. The collapsible tubing caulking gun according to claim 9 wherein the grip flap is moved to a grip open position where the sealed end of the collapsible tube is removed or inserted into the tube grip by releasing the grip fastener and pivoting the grip flap.

12. The collapsible tubing caulking gun according to claim 11 wherein the grip armature is an armature that couples to the grip backer and slidably couples to the handle;

wherein the grip armature is moved rearward by the action of squeezing the trigger and the handle;

wherein the grip armature is moved forward by force exerted by a grip spring;

wherein a grip release prevents the grip armature from moving forward unless the grip release is activated.

13. The collapsible tubing caulking gun according to claim 12 wherein the grip release is activated by pressing the bottom of the grip release towards the handle.

14. The collapsible tubing caulking gun according to claim 12 wherein a release spring holds the grip release in a position that prevents movement of the grip armature.

15. The collapsible tubing caulking gun according to claim 14 wherein the nozzle support supports the front of the collapsible tube at the nozzle.

16. The collapsible tubing caulking gun according to claim 15 wherein the nozzle support comprises a nozzle support armature, a nozzle aperture, and a nozzle release;

wherein the nozzle support armature is one or more armatures that extend forward to the nozzle of the collapsible tube;

wherein the nozzle aperture is an opening at the front of the nozzle support armature that is oriented to surround the nozzle;

wherein the nozzle is inserted into the nozzle aperture to support the front of the collapsible tube.

17. The collapsible tubing caulking gun according to claim 16 wherein the nozzle support armature extends towards the rear of the collapsible tubing caulking gun and slidably couples with the grip armature via the nozzle release;

wherein the nozzle release couples the nozzle support armature to the grip armature such that the nozzle support armature moves with the grip armature when the nozzle release is in an engaged position;

wherein the nozzle release decouples the nozzle support armature from the grip armature such that the nozzle support armature moves independently of the grip armature when the nozzle release is in a disengaged position;

wherein the nozzle support armature is moved independently of the grip armature to adjust a distance between the nozzle aperture and the tube grip to match the size of the collapsible tube.

18. The collapsible tubing caulking gun according to claim 17 wherein the nozzle release is a thumbscrew, the engaged position is a tightening of the nozzle release, and the disengaged position is a loosening of the nozzle release.

* * * * *